US010940713B2

(12) United States Patent
Lim

(10) Patent No.: US 10,940,713 B2
(45) Date of Patent: Mar. 9, 2021

(54) THERMOCHROMIC WRITING INSTRUMENT HAVING A SEPARABLE ERASER

(71) Applicant: Heemangnote Co., Ltd., Goyang-si (KR)

(72) Inventor: Seung Jae Lim, Goyang-si (KR)

(73) Assignee: Heemangnote Co., Ltd., Goyang-si (KR)

( * ) Notice: Subject to any disclaimer, the term of this patent is extended or adjusted under 35 U.S.C. 154(b) by 0 days.

(21) Appl. No.: 16/388,223

(22) Filed: Apr. 18, 2019

(65) Prior Publication Data

US 2020/0282764 A1 Sep. 10, 2020

(30) Foreign Application Priority Data

Mar. 7, 2019 (KR) ..... 10-2019-0026070

(51) Int. Cl.

| | |
|---|---|
| ***B43K 29/02*** | (2006.01) |
| ***B43K 7/12*** | (2006.01) |
| ***B43K 24/08*** | (2006.01) |
| *B43K 25/02* | (2006.01) |

(52) U.S. Cl.

CPC ..... *B43K 29/02* (2013.01); *B43K 7/12* (2013.01); *B43K 24/08* (2013.01); *B43K 24/082* (2013.01); *B43K 24/084* (2013.01); *B43K 25/028* (2013.01)

(58) Field of Classification Search

CPC ..... B43K 29/02; B43K 24/08; B43K 7/12; B43K 24/00; B43K 24/02; B43K 25/02; B43K 25/028

USPC ..... 401/195, 109, 110, 111, 112, 49, 52

See application file for complete search history.

(56) References Cited

U.S. PATENT DOCUMENTS

| | | | | |
|---|---|---|---|---|
| 4,991,988 | A * | 2/1991 | Snell | B43K 24/084 401/109 |
| 6,280,110 | B2 * | 8/2001 | Lin | B43K 24/08 401/104 |
| 6,309,129 | B1 * | 10/2001 | Kageyama | B43K 24/08 401/104 |
| 9,108,456 | B2 * | 8/2015 | Ito | B43K 25/028 |

FOREIGN PATENT DOCUMENTS

| | | |
|---|---|---|
| JP | H 04-007191 U | 1/1992 |
| JP | H 05-67410 A | 3/1993 |
| JP | H 05-058378 U | 8/1993 |
| JP | 3085623 U | 2/2002 |
| JP | 2002-301896 A | 10/2002 |

(Continued)

*Primary Examiner* — David J Walczak
(74) *Attorney, Agent, or Firm* — Stein IP, LLC

(57) ABSTRACT

A thermochromic writing instrument capable of causing curiosity and interest of a user by configuring an eraser to be easily separated from the main body of the thermochromic writing instrument and to be shaped into various character dolls. A rotation member is inserted into a pen body and a hollow upper cover is detachably coupled to an outside of the upper portion of the pen body, a first eraser is connected to the rotation member by a connection member, a connection portion of an operation member is disposed in a groove formed at one side of the side wall of the pen body, the first body portion of the operation member is inserted into the pen body and a clip portion of the operation member is exposed to the outside of the pen body.

9 Claims, 9 Drawing Sheets

(56) References Cited

FOREIGN PATENT DOCUMENTS

| | | | |
|---|---|---|---|
| JP | 3094123 | U | 3/2003 |
| JP | 3170299 | U | 8/2011 |
| JP | 2013-214208 | A | 10/2013 |
| JP | 2013-252699 | A | 12/2013 |
| JP | 2015-155208 | A | 8/2015 |
| JP | 2016-078277 | A | 5/2016 |
| JP | 2016-203453 | A | 12/2016 |
| JP | 2017-013502 | A | 1/2017 |
| JP | 2017-94600 | A | 6/2017 |
| JP | 2018-094728 | A | 6/2018 |
| JP | 2018-108663 | A | 7/2018 |
| KR | 20-2000-0024837 | Y1 | 9/2000 |
| KR | 20-0214567 | Y1 | 12/2000 |
| KR | 20-0461747 | Y1 | 8/2012 |
| KR | 20-0461947 | Y1 | 8/2012 |
| KR | 20-0469724 | Y1 | 11/2013 |
| KR | 10-1495366 | B1 | 2/2015 |
| KR | 10-1552782 | B1 | 9/2015 |
| KR | 10-2017-0105135 | A | 9/2017 |
| KR | 10-1827839 | B1 | 2/2018 |

* cited by examiner

THERMOCHROMIC WRITING INSTRUMENT HAVING A SEPARABLE ERASER

CROSS-REFERENCE TO RELATED APPLICATION

This application claims the priority benefit of Korean Patent Application No. 10-2019-0026070, filed on Mar. 7, 2019 in the Korean Intellectual Property Office, the disclosure of which is incorporated herein by reference.

BACKGROUND

The present invention relates to a thermochromic writing instrument, and more particularly, to a thermochromic writing instrument which is configured to be capable of easily separating an eraser which rubs with handwriting written by the thermochromic writing instrument and thermally discolors the handwriting using rubbed heat generated at this time from a main body of the thermochromic writing instrument and is provided, as a shape, with various character dolls and thus is convenient to use and is capable of causing curiosity and interest of a user to double the pleasure of use.

As you know, a ball pen is an abbreviation of a ballpoint pen and is a modern writing instrument. The ball pen has a hole filled with viscous ink therein. The ball pens have been replacing fountain pens as a daily handwriting instrument that is very cheap, reliable, and is not lifting much money on the purchase and use.

The ball pen that is used by being filled with ink is widely used because of economic feasibility and convenience thereof. Unlike a pencil, there is a problem that it cannot be corrected after writing, so a ball pen which is erased is developed and marketed by Pilot which is a traditional writing instrument company of Japan, around 2007.

A thermochromic writing instrument disclosed in Korean Registration Patent Publication No. 10-1495366 (Registration date: Feb. 13, 2015), as a product developed by the Japan Pilot, employs a gel ink which is erased and when texts are written and then the texts rub with a plastic eraser provided on the top of the ball pen, the texts disappear. The mechanism of the principle thereof differs from the mechanism in which texts writing by a pencil are erased by the rubber eraser. In other words, while since the texts written by the pencil are in a state where graphite is stained on paper, when rubbing with the rubber eraser, the graphite sticks to the eraser and is removed, the gel ink of the ball pen which is erased is a thermosensitive ink whose color changes according to temperature and is an ink which is seen only between about −10 degrees and about +60 degrees. The gel ink is one that uses the principle that color molecules are chemically reacted by the rubbed heat generated when rubbing with the plastic eraser and then the color disappears.

The thermochromic writing instrument can perform the handwriting while causes a pen point 810 of a writing body 8 to protrude and be retracted from a front end hole 31 of a shaft tube 2 by installing an operating unit 5 on a outer surface of the shaft tube 2 and operating the operating unit 5, and then operating the operating unit 5, and includes a rubbed portion 4 which is capable of erasing the handwriting of the thermochromic ink 82 using the rubbed heat.

However, since the rubbed portion 4 is integrally formed on the upper portion or the lower portion of the shaft tube 2 in this thermochromic writing instrument, the writing instrument has to be used only in a state of being turned over so as to use the rubbed portion 4 attached to the upper portion of the shaft tube 2 after writing, alternatively, the writing instrument has to be used only after the operating unit 5 is operated and thus the pen point 810 is retracted in the shaft tube 2 so as to use the rubbed portion 4 attached to the lower portion of the shaft tube 2. Therefore, there is a problem that it is inconvenient to use when erasing written contents. In addition, there is a problem that consumers' desire to use the writing instruments having diverse and interesting design cannot be properly satisfied, due to limitations in product design.

Therefore, there has been a need to develop the thermochromic writing instrument that overcomes the disadvantages of the thermochromic writing instrument developed by the Pilot and improves the convenience of use.

PRIOR ART DOCUMENT

Korean Registration Patent Publication No. 10-1495366 (Registration date: Feb. 13, 2015)

Korean Registration Patent Publication No. 10-1552782 (Registration Date: Sep. 7, 2015)

SUMMARY

A Technical task to be solved by the present invention is to provide a thermochromic writing instrument which is convenient to use by configuring to be capable of easily separating an eraser, which rubs with handwriting written by the thermochromic writing instrument and thermally discolors the handwriting using the rubbed heat generated at this time, from a main body of the thermochromic writing instrument.

In addition, a technical task to be solved by the present invention is to provide a thermochromic writing instrument which is capable of causing curiosity and interest of a user to double the pleasure of use by shaping an eraser, which rubs with handwriting written by the thermochromic writing instrument and thermally discolors the handwriting using rubbed heat generated at this time, into various character dolls.

So as to solve the technical tasks described above, according to a first aspect of the present invention, the present invention provides a thermochromic writing instrument including: a hollow cylindrical pen body which has upper and lower openings; a pen shim which is inserted into the pen body and accommodates a thermochromic ink composition therein; a spring which elastically supports the pen shim; and a lower cap which is fastened to a lower portion of the pen body in a threaded manner, characterized by comprising:

an operation member which is inserted into the pen body so that a portion of the operation member is exposed to the outside, the operation member including: a cylindrical first body portion, a connection portion extending from a side of the first body portion in a radial direction by a predetermined length perpendicular to the first body portion, and a clip portion integrally formed on a free end portion of the connection portion;

a rotation member which is rotatably inserted into the pen body, the rotation member including: a cylindrical second body portion; and an enlarged portion being enlarged outwardly from the lower portion of the second body portion in the radial direction so as to have an outer diameter larger than the outer diameter of the second body portion;

a hollow upper cover which is detachably coupled to an upper outside of the pen body;

a first eraser which rubs with the handwriting written by the thermochromic writing instrument and thermally discolors the handwriting using the rubbed heat generated at this time; and a connection member which connects the first eraser and the rotation member to each other.

A groove is formed on a side of a side wall of the pen body, the first body portion is inserted into the pen body, the connection portion is disposed to pass through the groove, and the clip portion is exposed to the outside of the pen body.

A first protrusion portion is formed on an upper portion of the pen body, a first latching jaw is formed on an outer surface of the first protrusion portion in the radial direction, a second latching jaw protrudes inward on the inner surface of the upper cover in the radial direction, and the upper cover is mounted on the protrusion portion by the user of the thermochromic writing instrument pushing the upper cover downward so that the second latching jaw passes the first latching jaw downward.

A first contact portion having a threaded shape may be formed on a lower-end portion of the first body portion, a plurality of second protrusion portions are formed on an outer peripheral surface of the enlarged portion with a predetermined gap therebetween, upper-end portions of the second protrusion portions may extend to a side of the second body portion in a state of passing a boundary between the second body portion and the enlarged portion, a second contact portion is formed on the upper-end portions of the second protrusion portions, and the second contact portion may be formed to be inclined at an acute angle corresponding to the shape of the first contact portion, and the second body portion except for the enlarged portion in the rotation member may be inserted into the first body portion.

The first eraser is configured with a first character-shaped portion and a character support portion integrally formed with the first eraser, a blind hole is formed in the character support portion to a predetermined depth, the character support portion passes the upper cover and is inserted into the pen body, and the character support portion is inserted into the upper portion of the first body portion of the operation member inserted into the pen body.

The first eraser is fabricated by mixing a rubber with a pressurized conductive material, in which the conductive material contains 60 to 70% by weight of siloxane and silicon, di-methyl, methyl vinyl, vinyl group-terminated, 30 to 40% by weight of carbon black and 1 to 10% by weight of other additives, based on the total weight thereof.

Further, according to a second aspect of the present invention, the present invention provides a thermochromic writing instrument including: a hollow cylindrical pen body which has upper and lower openings; a pen shim which is inserted into the pen body and accommodates a thermochromic ink composition therein; a spring which elastically supports the pen shim; and a lower cap which is fastened to a lower portion of the pen body in a threaded manner, characterized by including:

an operation member which is inserted into the pen body so that a portion of the operation member is exposed to the outside, the operation member including: a cylindrical first body portion, a connection portion extending from a side of the first body portion in a radial direction by a predetermined length perpendicular to the first body portion, and a clip portion integrally formed on a free end portion of the connection portion;

a rotation member which is rotatably inserted into the pen body, the rotation member including: a cylindrical second body portion; and an enlarged portion being enlarged outwardly from the lower portion of the second body portion in the radial direction so as to have an outer diameter larger than the outer diameter of the second body portion;

a hollow upper cover which is coupled to an upper outside of the pen body;

an eraser means which rubs with the handwriting written by the thermochromic writing instrument and thermally discolors the handwriting using the rubbed heat generated at this time; and A pressing portion which causes the pen shim to be exposed to a lower portion of the pen body and is capable of performing pressing and rotating operations; and a connection member which connects the pressing portion and the rotation member to each other.

The eraser means is a second eraser which is provided so as to be capable of being detachably attached to the clip portion of the operation member, the second eraser is formed of a second character-shaped portion integrally formed with the second eraser, and a clip portion insertion hole into which the clip portion can be inserted is formed on the second character-shaped portion so as to pass through the second character-shaped portion in the vertical direction.

Alternatively, the eraser means is a third eraser which is provided so as to be capable of being detachably attached on an outer surface of the pen body in the radial direction, the third eraser includes a third character-shaped portion and a mounting ring integrally formed with the third eraser, and the mounting ring is attached such that the radial upper portion thereof is integrally fixedly supported on the lower surface of the third character-shaped portion.

Alternatively, the eraser means is a fourth eraser which is provided so as to be capable of being detachably attached on an outer surface of the pen body in the radial direction, the fourth eraser includes a fourth character-shaped portion and a mounting piece integrally formed with the fourth eraser, the mounting piece is attached so that the upper portion thereof is integrally fixedly supported on both lower surfaces of the fourth character-shaped portion, and the fitting portion is bent inward under the mounting piece, corresponding to this, a fitting groove is formed on both outer surfaces of the pen body in the radial direction so as to extend along the longitudinal direction of the pen body, and the eraser is mounted on the pen body in such a manner that the fitting portions are inserted into the fitting grooves, respectively.

As described above, according to the present invention, the eraser of a thermochromic writing instrument can be easily separated from a main body of the thermochromic writing instrument, so that a convenient use effect thereof can be obtained. In addition, the eraser of the thermochromic writing instrument is configured to be also rotatable according to the embodiment and shaped into various character dolls, so that curiosity and interest of the user of the writing instrument can be generated and the pleasure of use can be doubled.

DETAILED DESCRIPTION OF THE EMBODIMENTS

Hereinafter, a thermochromic writing instrument having a separable eraser according to preferred embodiments of the present invention will be described.

Figure 1:
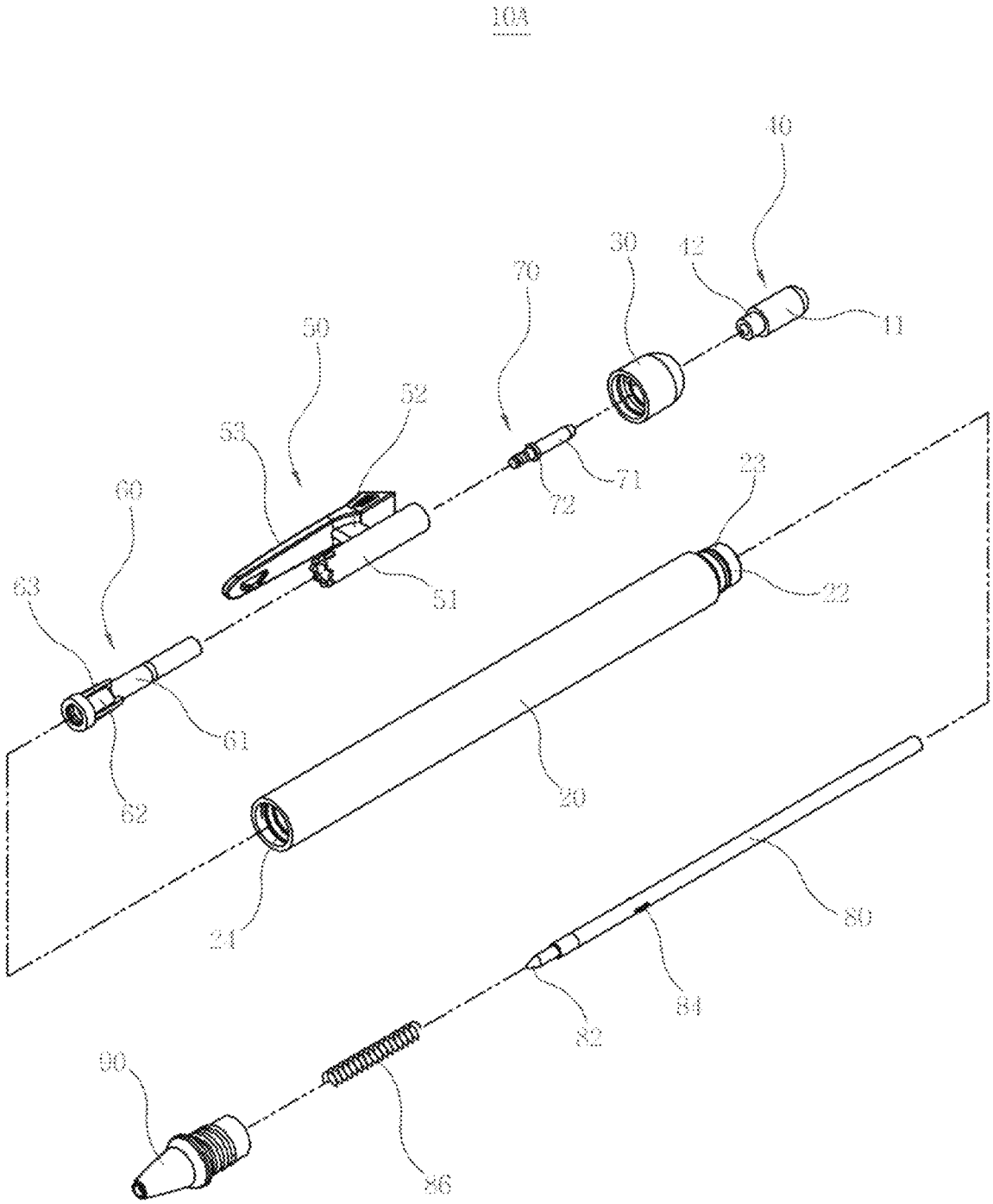
FIG. 1 is an exploded perspective view illustrating a thermochromic writing instrument having a rotatable and separable eraser according to a first preferred embodiment of the present invention.
Figure 2:
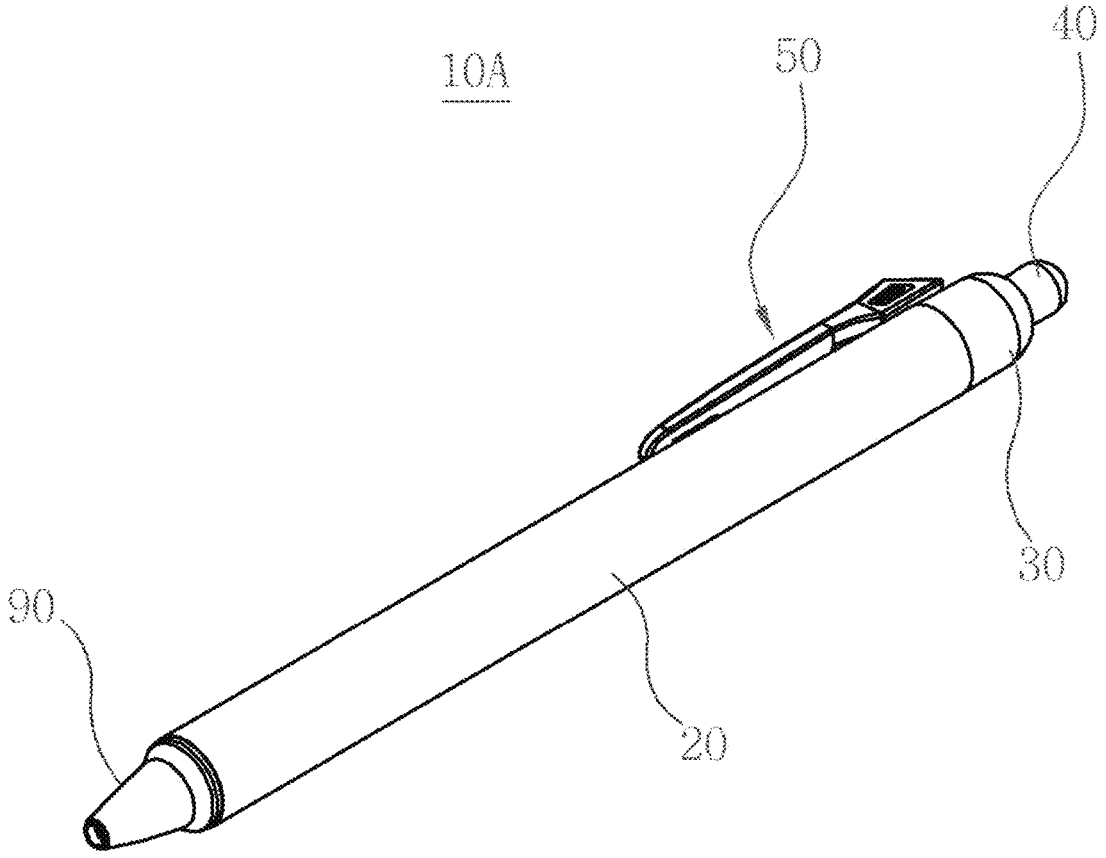
FIG. 2 is a perspective view illustrating a coupled state of the thermochromic writing instrument illustrated in FIG. 1.

First, FIGS. 1 and 2 illustrate a thermochromic writing instrument 10A having a first eraser 40 which is rotatable and separable according to a first preferred embodiment of the present invention. The first eraser 40 according to the first preferred embodiment of the present invention is rotatably and separably mounted on an upper portion of the thermochromic writing instrument 10A.

The thermochromic writing instrument 10A includes a hollow cylindrical pen body 20 having upper and lower openings, a hollow upper cover 30 coupled to the upper outside of the pen body 20, a first eraser 40 rotatably and separably mounted on the upper inside of the pen body 20 through the upper cover 30, an operation member 50 inserted into the pen body 20 such that a portion of the operation member is exposed to the outside, a rotation member 60 rotatably inserted into the pen body 20, a connection member 70 for connecting the first eraser 40 and the rotation member 60 to each other, a pen shim 80 inserted into the pen body 20 and accommodating a thermochromic ink composite therein, a spring 86 for resiliently supporting the pen shim 80, and a lower cap 90 which is fastened to the lower portion of the fan body 20 in a threaded manner.

Firstly, a groove 21 (see FIG. 4 and FIG. 5) for enabling the operation of the operation member 50 are formed on one side of the side wall of the cylindrical pen body 20 by cutting by a predetermined length along the longitudinal direction of the pen body 20. A first protrusion portion 22 is formed on an upper portion of the pen body 20 and a first latching jaw 23 is formed on a outer surface of the first protrusion portion 22 in the radial direction. The upper cover 30 is fitted and coupled on the outside of the first protrusion portion 22 in the radial direction, and to this end, a second latching jaw 33 (see FIG. 5) protrudes inward on the radially inner surface of the upper cover 30 in the radial direction. On the lower inner surface of the pen body 20 in the radial direction, a female threaded portion 24 is formed. The lower cap 90 is fastened to the female threaded portion 24 in a threaded method.

Next, the first eraser 40 rubs with the handwriting written by the thermochromic writing instrument 10A and performs a function of thermally discoloring the handwriting using the rubbed heat generated at this time. The first eraser 40 is configured with a first character-shaped portion 41 and a character support portion 42 which are integrally formed with the first eraser. A blind hole (reference numeral omitted) starting from the character support portion 42 is formed on the inside of the first character-shaped portion 41 and the character support portion 42 by a predetermined depth.

Figure 6:
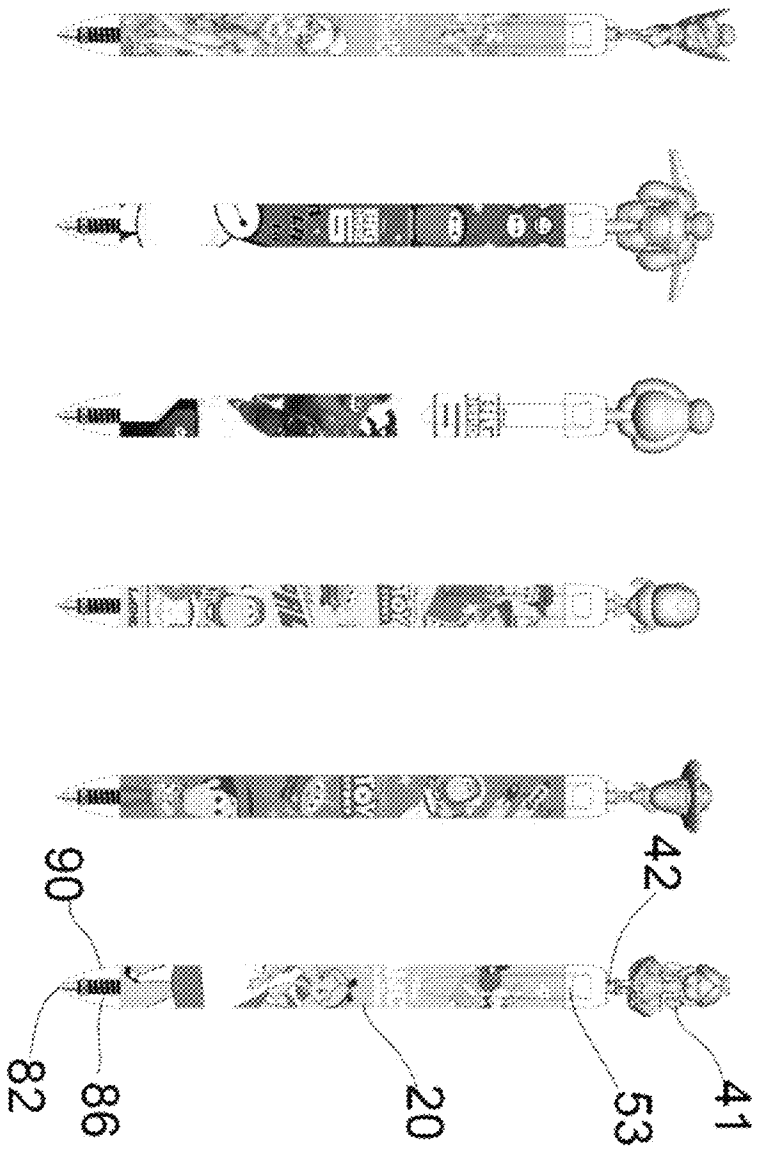
FIG. 6 is a view illustrating examples of various characters that can be used as an eraser in a first preferred embodiment of the present invention.

FIG. 6 illustrates the first eraser 40 according to a first preferred embodiment of the present invention. As illustrated in FIG. 6, the first eraser 40 may be made of rubber or a synthetic resin material. In particular, the first character-shaped portion 41 may be shaped into various types of characters so as to stimulate the curiosity and aesthetics of the user.

Referring to FIG. 1 and FIG. 6, the character support portion 42 passes the upper cover 30 and is inserted into the pen body 20, and at this time, is inserted into the upper portion of the first body portion 51 of the operation member 50, which is inserted into the pen body 20. The first eraser 40 performs a role of generating rubbed heat to erase the ink after the handwriting is performed by a thermochromic writing instrument 10A using the characteristics of a Zion pigment among raw materials constituting the thermochromic ink composition I (see FIGS. 4 and 5). In other words, since the reversible Zion pigment constituting the thermochromic ink composition (I) becomes transparent when reaching the reference temperature and returns to the original color thereof when the temperature is lowered again, the ink is erased using the first eraser 40 based on the characteristics of the Zion pigment. The reference temperature of the reversible Zion pigment is from 25° C. to 65° C.

According to the present invention, preferably, the first eraser 40 is fabricated by mixing a pressurized conductive material to the rubber used as the raw material for fabricating the first eraser 40. Normally, rubber is known as a nonconductive insulator through which electricity does not flow, but when a certain pressure is applied by adding carbon black or the like, an electric signal can be generated due to the piezoelectric effect, so that the conductive rubber can be made conductive. In other words, when the conductive rubber is in contact with a contact circuit, a switch may be turned ON, and since, when the first eraser 40 of the present invention, which is manufactured by reflecting such characteristics, is in contact with, for example, the screen of the mobile phone, the electrical signal can be transferred by causing current to flow to the circuit of the mobile phone, it is possible to activate the mobile phone's application.

The conductive material contained as a component of the raw material for manufacturing the first eraser 40 is characterized by containing 60 to 70% by weight of siloxane and silicone, di-methyl, methyl vinyl, vinyl group-terminated, 30% to 40% by weight of carbon black, and 1% to 10% by weight of other additives, based on the total weight of the conductive material.

Meanwhile, the operation member 50 is configured with a cylindrical first body portion 51, a connection portion 52 extending from a side of the first body portion 51 in the radial direction by a predetermined length perpendicular to the first body portion 51, and a clip portion 53 integrally connected to the free end portion of the connection portion 52 and extending by a predetermined length along the longitudinal direction of the first body portion 51. In a case where the operation member 50 is installed on the pen body 20, the first body portion 51 is inserted into the pen body 20 and the connection portion 52 is disposed so as to pass through the groove 21 of the pen body 20, and the clip portion 53 is exposed to the outside of the pen body 20.

A rotation member 60 is inserted and disposed in a lower portion of the first body portion 51 in a state where the first body portion 51 is inserted into the pen body 20, and the connection member 70 is inserted into the body portion 51.

Figure 3:
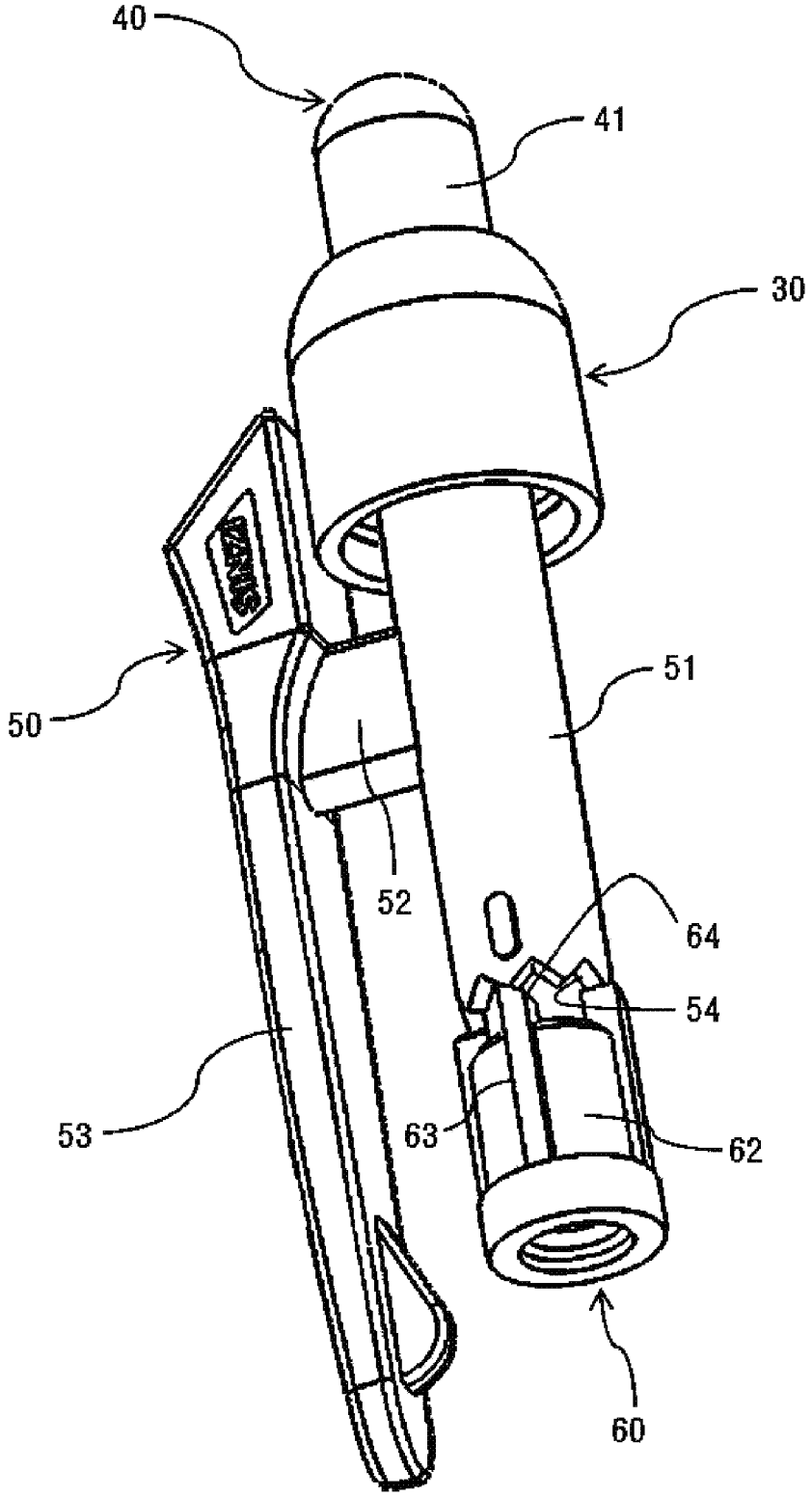
FIG. 3 is a perspective view illustrating a coupled state of some of the components of the thermochromic writing instrument illustrated in FIG. 1.

FIG. 3 is a view illustrating a combined state of some of the components of the thermochromic writing instrument 10A illustrated in FIG. 1.

As illustrated in FIG. 3, a first contact portion 54 having a saw-tooth shape is formed at the lower-end portion of the first body portion 51. The first contact portion 54 is in contact with the second contact portion 64 of the rotation member 70, which will be described later.

Referring to FIG. 1 and FIG. 3, the rotation member 60 includes a cylindrical second body portion 61 and an enlarged portion 62 which is enlarged toward the outside in the radial direction so as to have an outer diameter larger than the outer diameter of the second body portion 61 at a lower portion of the second body portion 61. A plurality of second protrusion portions 63 are formed on the outer peripheral surface of the enlarged portion 62 in the radial direction. The second protrusion portions 63 are formed on the outer peripheral surface of the enlarged portion 62 in the radial direction with a predetermined gap, and the upper-end portion of the second protrusion portion 63 extends to a side of the second body portion 61 passing a boundary between the second body portion 61 and the enlarged portion 62. The second contact portion 64 described above is formed at an upper-end portion of the second protrusion portions 63 so that the second contact portion 64 is formed to be inclined at an acute angle corresponding to the shape of the first contact portion 54. The second body portion 61 of the rotation member 60 has an outer diameter smaller than the inner diameter of the first body portion 51 of the operation member 50 so that the second body portion 61 except for the enlarged portion 62 in the rotation member 60 can be inserted into the first body portion 51 of the operation member 50.

In a state where the second body portion 61 of the rotation member 60 is inserted into and disposed on the first body portion 51 of the operation member 50, the connection member 70 is inserted into the second body portion 61. The connection member 70 includes a third body portion 71 having a generally pin-like shape and a latching portion 72 protruding outward from an intermediate position of the third body portion 71 in the radial direction. The upper portion of the third body portion 71 with respect to the latching portion 72 as a boundary can be inserted into the character support portion 42 of the first eraser 40.

Meanwhile, the pen shim 80 is disposed inside the pen body 20 as in the related art, the upper portion of the pen shim 80 is fitted to the lower portion of the rotation member 60 and the lower portion of the pen shim 80 is exposed to the outside of the lower portion of the pen body 20. A ball pen point 82 is attached to the lower end of the pen shim 80 and a spring stopper 84 is formed on the lower outer surface of the pen shim 80 in the radial direction so as to protrude radially outward. The inside of the pen shim 80 is filled with the thermochromic ink composition I (see FIGS. 4 and 5). The thermochromic writing instrument 10A also includes a spring 86 disposed on the outer surface of the pen shim 80 in the pen body 20 in the radial direction to elastically support the pen shim 80, and a lower cap 90 which is fastened to the lower portion of the pen body 20 in a threaded manner.

The thermochromic ink composition I used in the preferred embodiment of the present invention is characterized by containing 50 to 80% by weight of a heat dissipation Zion pigment composition, 5 to 15% by weight of a moisturizer, 0.1 to 3.0% by weight of an emulsifier, 0.1 to 1 wt % of a thickener, 0.2 to 0.8 wt % of a preservative, 1 to 5 wt % of a penetrating agent, 0.1 to 1 wt % of a rust inhibitor, 0.1 to 1 wt % of a solubilizing agent, the remaining water, and the remaining water and water soluble polar solvent, based on the total weight thereof.

The heat dissipation Zion pigment composition is characterized in that it comprises a pigment dispersion having a particle size in the range of 1 μm to 5 μm and a solid content of 30%. Preferably, the optimum particle size of the heat dissipation Zion pigment composition is 2 μm. If the particle size is more than 10 μm, the outflow from the ball pen point 82 becomes worse, and a phenomenon of clogging occurs over time.

Figure 4:
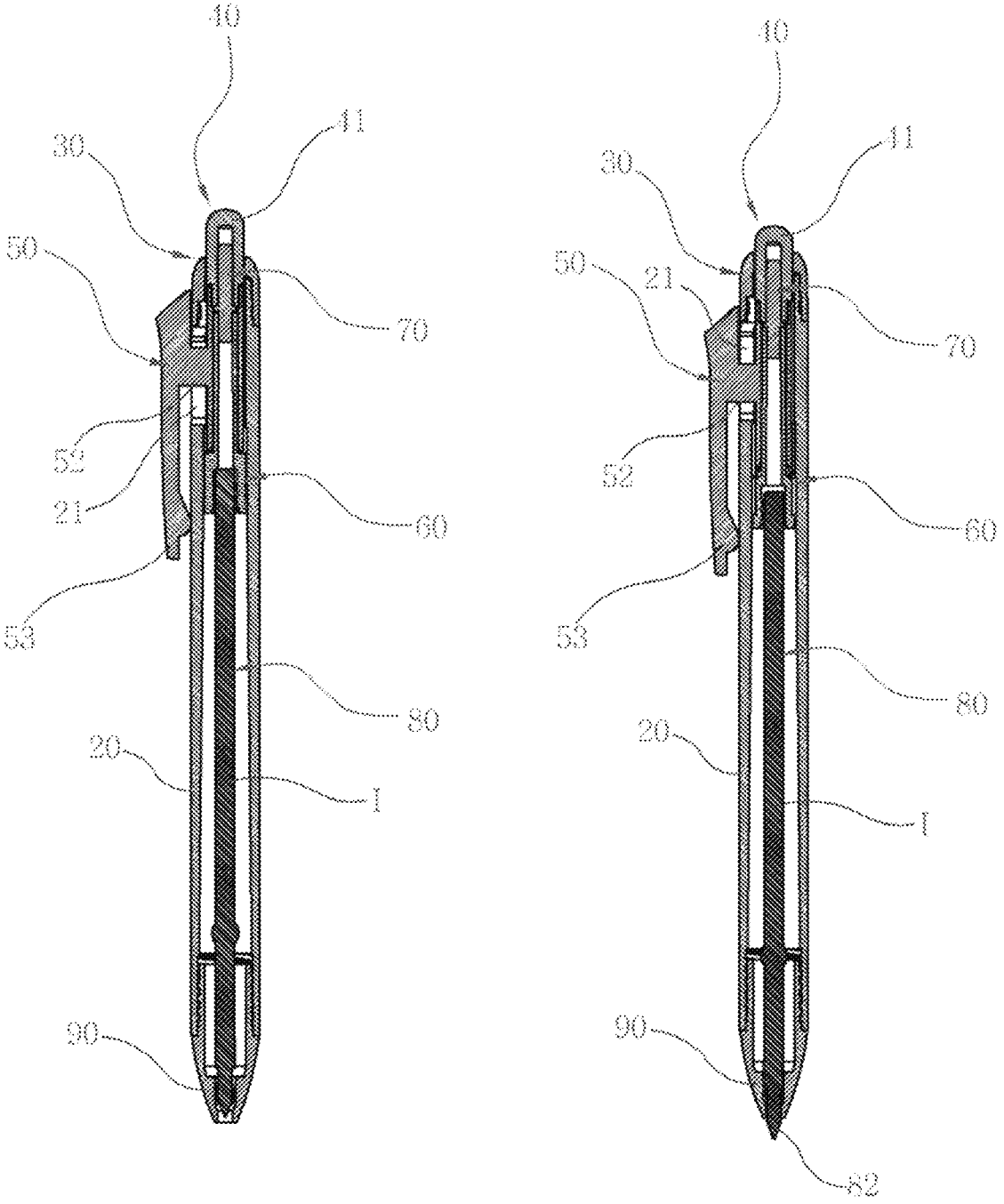
FIG. 4 is a sectional view illustrating a coupled state of the thermochromic writing instrument illustrated in FIG. 1, illustrating the state before use and after use.
Figure 5:
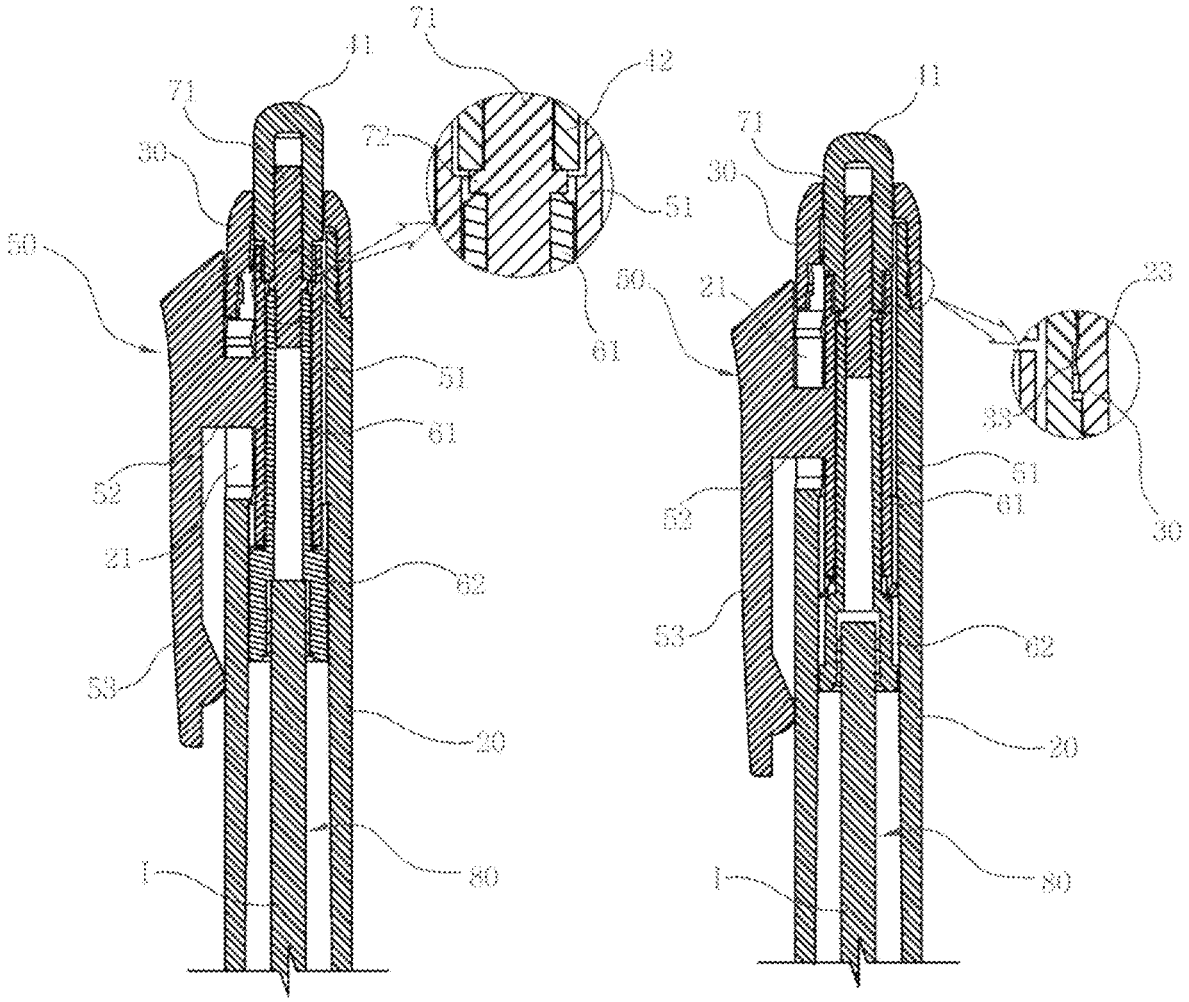
FIG. 5 is a partially enlarged view of the thermochromic writing instrument illustrated in FIG. 4.

FIGS. 4 and 5 are sectional views illustrating a coupled state of the thermochromic writing instrument 10A, and illustrate states before and after the user of the writing instrument 10A presses the operation member 50.

As illustrated in the left side of FIGS. 4 and 5, when a state before the user of the writing instrument 10A presses the operation member 50 will be briefly described, as described above, the operation member 50 is disposed in a manner that the connection portion 52 is passed through the groove 21 of the pen body 20 and the first body portion 51 is inserted into the pen body 20.

The rotation member 60 is disposed in such a manner that the second body portion 61 except for the enlarged portion 62 is inserted into the first body portion 51 from bottom to top and the connection member 70 is disposed in such a manner that the third body portion 71 is inserted into the second body portion 61 from top to bottom.

In this state, the upper cover 30 is fitted and mounted on the outer surface of the first protrusion portion 22 in the radial direction provided on the upper portion of the pen body 20 in a pressed manner. In other words, the second latching jaw 33 formed on the inner surface of the upper cover 30 in the radial direction presses the upper cover 30 in the downward direction and mounted so as to pass the first latching jaw 23 formed on the outer surface of the first protrusion portion 22 in the radial direction in the downward direction. Once the upper cover 30 is mounted on the outer surface of the first protrusion portion 22 in the radial direction, the upper cover 30 is held in this position unless the user applies an external force in the upward direction.

Next, the third body portion 71 of the connection member 70 is pressed in the downward direction so as to be inserted inside the character support portion 42 and fastened while the first eraser 40 is positioned into the upper cover 30 so that the character support portion 42 of the first eraser 40 passes over the inner space of the upper cover 30.

As indicated in the right side of FIGS. 4 and 5, when the user of the writing instrument 10A presses the operation member 50, the connection portion 52 of the operation member 50 moves from the upper position to the lower position of the groove 21 so that the first body portion 51 of the operation member 50 moves downward in the inner space of the pen body 20.

As can be better seen in FIG. 3, when the first body portion 51 of the operation member 50 is pressed downward, the first contact portion 54 provided at the lower-end portion of the first body portion 51 pushes the inclined surface of the second contact portion 64 while being in contact with the second contact portion 64 of the rotation member 60. Then, the first body portion 51 of the operation member 50 is rotated by the joint operation between the first contact portion 54 and the second contact portion 64. As a result, the first eraser 40 fitted into and mounted on the third body portion 71 of the connection member 70 inserted into the rotation member 60 rotates in the same manner as the first body portion 51.

As a result, when the operation member 50 is pressed, the first eraser 40 rotates while descending downward, and on the other hand, when the operation member 50 is returned to the original position, the first eraser 40 is rotated while ascending upward. Therefore, the user of the thermochromic writing instrument 10A according to the present invention can perform the writing work while feeling the interest when using the writing instrument 10A.

As described above with reference to FIG. 6, the first character-shaped portion 41 of the first eraser 40 is shaped into various types of characters, so that the user of the thermochromic writing instrument 10A primarily has a sense of aesthetics and good feeling to the character dolls, and can feel curiosity and fun because the user can see a state where the character dolls ascends, descends, and rotates.

Figure 7:
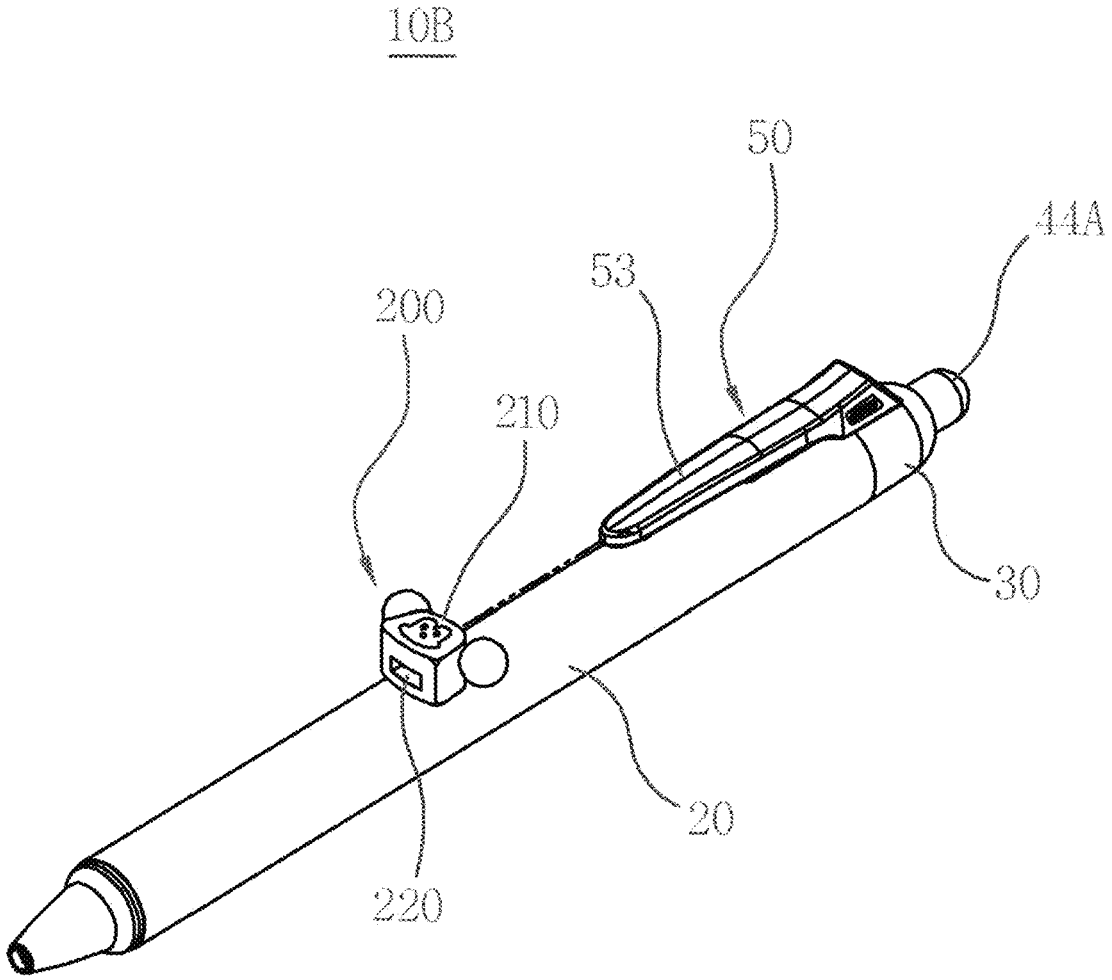
FIG. 7 is a view illustrating a modified example of a thermochromic writing instrument having a separable eraser according to a second preferred embodiment of the present invention.

On the other hand, FIG. 7 illustrates a thermochromic writing instrument 10B according to a second preferred embodiment of the present invention. According to the second embodiment illustrated in FIG. 7, a pressing portion 44A which can simply expose the pen shim 80 to the lower portion of the pen body 20 and at the same time perform the pressing and rotating operations without performing a role of erasing the ink is disposed on the corresponding position of the first eraser 40 which perform the role of generating the rubbed heat and erasing the ink after the handwriting is performed by the thermochromic writing instrument 10A in the first embodiment described above. A person skilled in the art will readily appreciate that the pressing portion 44A can be made into a simple shape with the eraser function removed or a character-shaped portion.

In addition, a separate second eraser 200, which is capable of performing a role of erasing the ink, is provided so as to be detachably attached to the clip portion 53 of the operation member 50. The second eraser 200 includes a second character-shaped portion 210 integrally formed with the second eraser and the second character-shaped portion 210 is formed with a clip portion insertion hole 220 to which the clip portion 53 of the operation member 50 can be fitted in a state of being passed through in the vertical direction. In a case where the thermochromic writing instrument 10B is not used, the user stores the second eraser 200 to the clip portion 53 in a manner of inserting the clip portion 53 of the operation member 50 into the clip portion insertion hole 220 formed in the second character-shaped portion 210, and in a case where the thermochromic writing instrument 10B is used, the user can draw out the second character-shaped portion 210 from the clip portion 53 of the operation member 50 and used.

Figure 8:
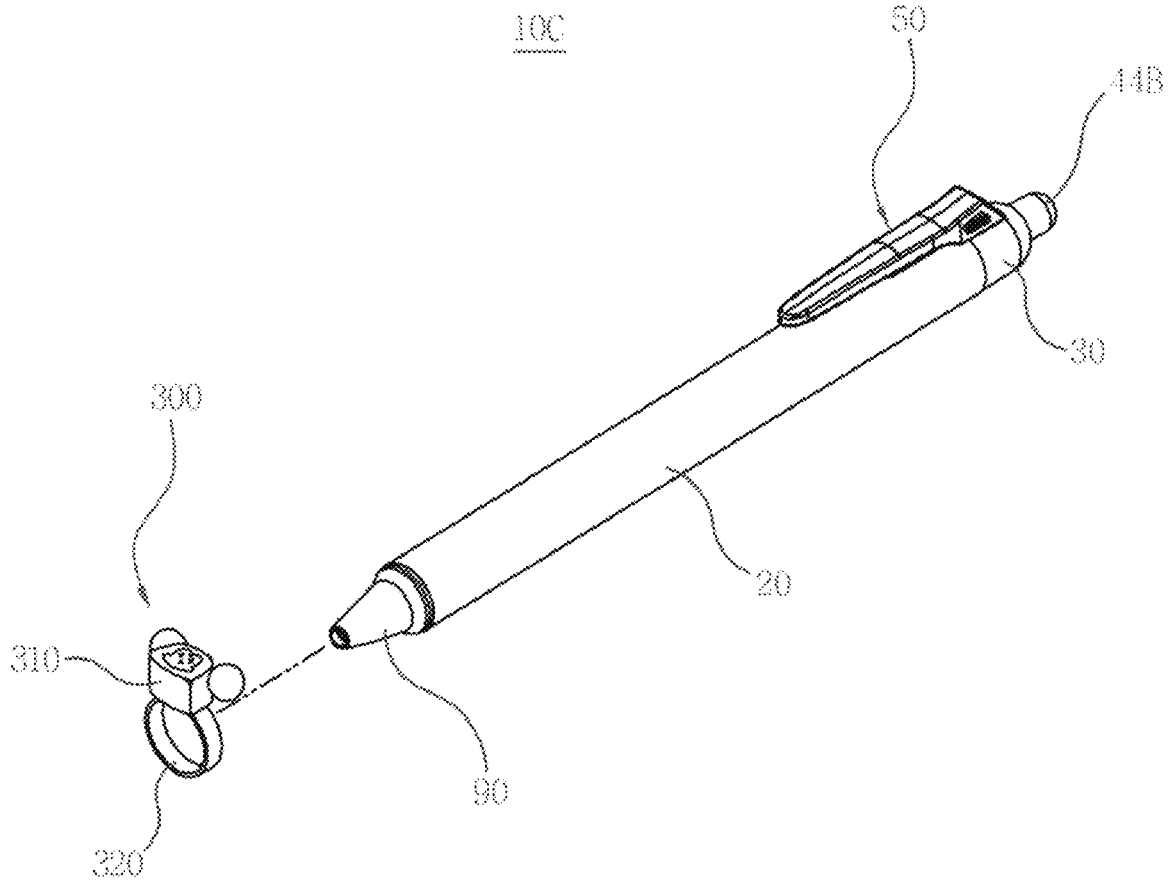
FIG. 8 is a view illustrating a modified example of a thermochromic writing instrument having a separable eraser according to a third preferred embodiment of the present invention.

Meanwhile, FIG. 8 illustrates a thermochromic writing instrument 10C according to a third preferred embodiment of the present invention. According to the third embodiment illustrated in FIG. 8, a pressing portion 44B which can simply expose the pen shim 80 to the lower portion of the pen body 20 and at the same time perform the pressing and rotating operations without performing a role of erasing the ink is disposed on the corresponding position of the first eraser 40 which perform the role of generating the rubbed heat and erases the ink after the handwriting is performed by the thermochromic writing instrument 10A in the first embodiment described above.

In addition, a separate third eraser 300, which can perform the role of erasing the ink, is provided so as to be detachably attached to the outer surface of the pen body 20 in the radial direction. The third eraser 200 includes a third character-shaped portion 310 and a mounting ring 320 which are integrally formed with the third eraser. The mounting ring 320 is attached so that the radial upper portion thereof is integrally fixed and supported to the lower surface of the third character-shaped portion 310. In a case where the thermochromic writing instrument 10B is not used, the user stores the third eraser 300 to the pen body 20 in a manner of fitting the pen body 20 to the mounting ring 320 attached to the lower surface of the third character-shaped portion 310, and in a case where the thermochromic writing instrument 10B is used, the user can draw out the third character-shaped portion 310 from the pen body 20 and used.

Figure 9:
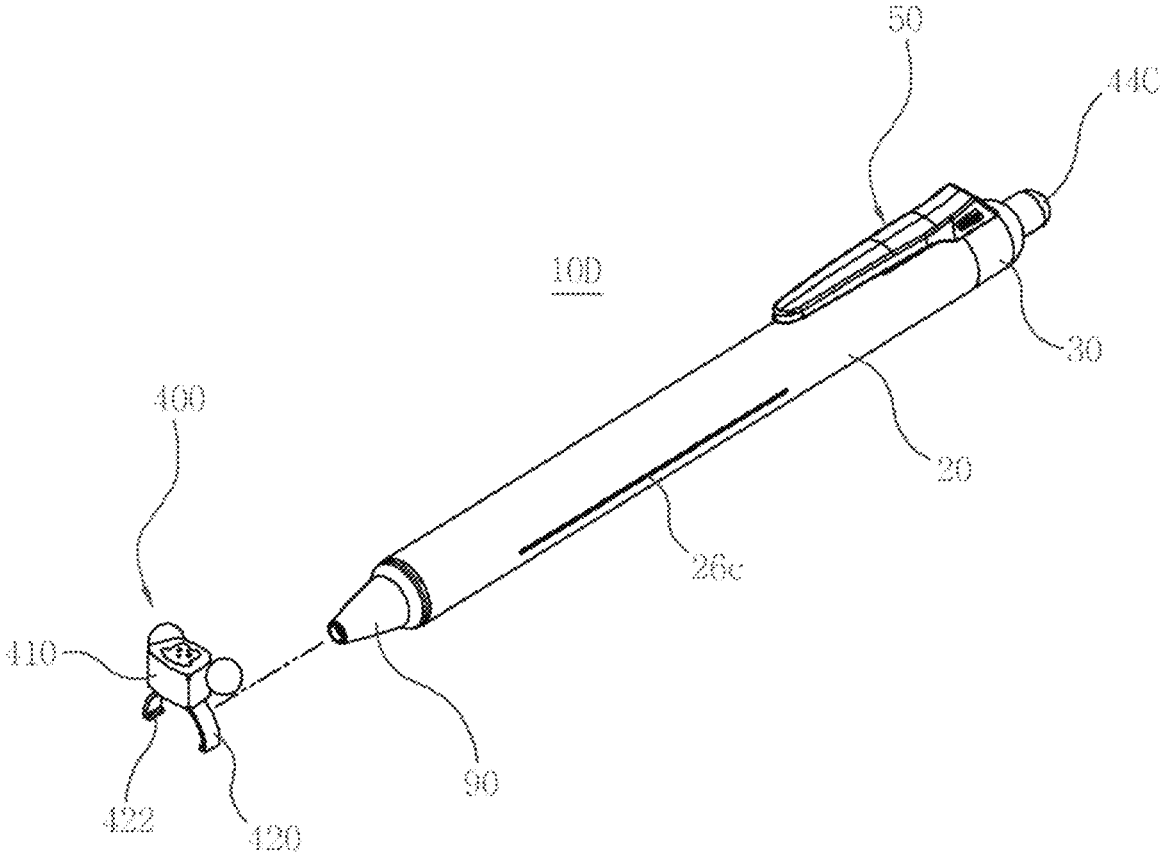
FIG. 9 is a view illustrating a modified example of a thermochromic writing instrument having a separable eraser according to a fourth preferred embodiment of the present invention.

Meanwhile, FIG. 9 illustrates a thermochromic writing instrument 10D according to a fourth preferred embodiment of the present invention. According to the fourth embodiment illustrated in FIG. 9, a pressing portion 44C which can simply expose the pen shim 80 to the lower portion of the pen body 20 and at the same time perform the pressing and rotating operations without performing a role of erasing the ink is disposed on the corresponding position of the first eraser 40 which perform the role of generating the rubbed heat and erases the ink after the handwriting is performed by the thermochromic writing instrument 10A in the first embodiment described above. A person skilled in the art will readily appreciate that the pressing portion 44C can be made into a simple shape with the eraser function removed or a character-shaped portion.

In addition, a separate fourth eraser 400, which can perform a role of erasing the ink, is provided to detachably attach on the outer surface of the pen body 20 in the radial direction. The fourth eraser 400 includes a fourth character-shaped portion 410 and a mounting piece 420 which are integrally formed with the fourth eraser. The upper portion of the mounting piece 420 is attached so as to be integrally fixed on both side lower surfaces of the fourth character-shaped portion 410. The mounting piece 420 has an approximately circular arc shape, and the fitting portion 422 is formed to be bent inward at the lower portion of the mounting piece 420. Correspondingly, fitting grooves 26C extend along the longitudinal direction of the pen body 20 on both outer surfaces of the pen body 20 in the radial direction. In a case where the thermochromic writing instrument 10C is not used, the user stores the fourth eraser 400 to the pen body 20 in a manner of fitting the fitting portion 422 of the mounting pieces 420 attached to both sides of the lower surface of the fourth character-shaped portion 410 to fitting grooves 26C of the pen body 20, respectively and in a case where the thermochromic writing instrument 10C is used, the user can use the fourth eraser 400 by drawing out the fitting portion 422 of the mounting piece 420 from the fitting groove 26C of the pen body 20 and used.

In the second, third, and fourth embodiments described above, since only the configuration and the mounting position of the eraser, and the form of the pen body related thereto are different, and the remaining configurations are the same, a person skilled in the art will readily understand that the same reference numerals are used for elements of the same invention.

Although the foregoing has been described with reference to preferred embodiments of the present invention, a person skilled in the art can understand that various modifications and variations can be made in the present invention without departing from the spirit and scope of the invention as defined in the appended claims.

EXPLANATION OF SYMBOLS

10A, 10B, 10C, 10D: thermochromic writing instrument
20: pen body
21: groove
22, 63: protrusion portion
23, 33: latching jaw
26C: fitting groove
30: upper cover
40, 200, 300, 400: eraser
41, 210, 310, 410: character-shaped portion
42: character support portion
44A, 44B, 44C: pressing portion
50: operation member
51, 61, 71: body portion
52: connection portion
53: clip portion
54: 64: contact portion
62: enlarged portion
70: connection member
72: latching portion
80: pen shim
82: ball pen point
86: spring
90: lower cap
220: clip portion insertion hole
320: mounting ring
420: mounting piece
422: fitting portion
I: thermochromic ink composition

What is claimed is:

1. A thermochromic writing instrument including: a hollow cylindrical pen body which has upper and lower openings; a pen shim which is inserted into the pen body and accommodates a thermochromic ink composition I therein; a spring which elastically supports the pen shim; and a lower cap which is fastened to a lower portion of the pen body in a threaded manner, characterized by comprising:

an operation member which is inserted into the pen body so that a portion of the operation member is exposed to outside, the operation member including: a cylindrical first body portion, a connection portion extending from a side of the first body portion in a radial direction by a predetermined length perpendicular to the first body portion, and a clip portion integrally formed on a free end portion of the connection portion;

a rotation member which is rotatably inserted into the pen body, the rotation member including: a cylindrical second body portion and an enlarged portion being enlarged outwardly from a lower portion of the second body portion in the radial direction so as to have an outer diameter larger than an outer diameter of the second body portion;

a hollow upper cover which is detachably coupled to an upper outside of the pen body;

a first eraser which rubs with the handwriting written by the thermochromic writing instrument and thermally discolors the handwriting using the rubbed heat generated at this time; and a connection member which connects the first eraser and the rotation member, wherein a groove is formed on a side of a side wall of the pen body, the first body portion is inserted into the pen body, the connection portion is disposed to pass through the groove, and the clip portion is exposed to an outside of the pen body, a first protrusion portion is formed on an upper portion of the pen body, a first latching jaw is formed on an outer surface of the first protrusion portion in the radial direction, a second latching jaw protrudes inward on the radially inner surface of the upper cover in the radial direction, and the upper cover is mounted on the first protrusion portion by the user of the thermochromic writing instrument pushing the upper cover downward so that the second latching jaw passes the first latching jaw downward.

2. The thermochromic writing instrument according to claim 1, characterized in that the first eraser is configured with a first character-shaped portion and a character support portion integrally formed with the first eraser, a blind hole is formed in the character support portion to a predetermined depth, the character support portion passes the upper cover and is inserted into the pen body, the character support portion is inserted into the upper portion of the first body portion of the operation member inserted into the pen body.

3. The thermochromic writing instrument according to claim 2, characterized in that the connection member includes a third body portion generally forming a pin shape and a latching portion protruding to the outside in the radial direction at a middle position of the third body portion, in a state where the second body portion of the rotation member is disposed by inserting into the first body portion of the operation member, the connection member is disposed by inserting into the second body portion, and an upper portion of the third body portion with respect to the latching portion as a boundary is inserted into the character support portion.

4. The thermochromic writing instrument according to claim 2, characterized in that the first eraser is fabricated by mixing a rubber with a pressurized conductive material, the conductive material contains 60 to 70% by weight of siloxane and silicon, di-methyl, methyl vinyl, vinyl group-terminated, 30 to 40% by weight of carbon black, and 1 to 10% by weight of other additives, based on the total weight thereof.

5. A thermochromic writing instrument including: a hollow cylindrical pen body which has upper and lower openings; a pen shim which is inserted into the pen body and accommodates a thermochromic ink composition I therein; a spring which elastically supports the pen shim; and a lower cap which is fastened to a lower portion of the pen body in a threaded manner, characterized by comprising:

an operation member which is inserted into the pen body so that a portion of the operation member is exposed to outside, the operation member including: a cylindrical first body portion, a connection portion extending from a side of the first body portion in a radial direction by a predetermined length perpendicular to the first body portion, and a clip portion integrally formed on a free end portion of the connection portion;

a rotation member which is rotatably inserted into the pen body, the rotation member including: a cylindrical second body portion and an enlarged portion being enlarged outwardly from a lower portion of the second body portion in the radial direction so as to have an outer diameter larger than an outer diameter of the second body portion;

a hollow upper cover which is detachably coupled to an upper outside of the pen body;

a first eraser which rubs with the handwriting written by the thermochromic writing instrument and thermally discolors the handwriting using the rubbed heat generated at this time; and a connection member which connects the first eraser and the rotation member, wherein a first contact portion having a saw-tooth shape is formed on a lower-end portion of the first body portion, a plurality of second protrusion portions are formed on an outer peripheral surface of the enlarged portion in the radial direction with a predetermined gap therebetween, upper-end portions of the second protrusion portions extend to a side of the second body portion in a state of passing through a boundary between the second body portion and the enlarged portion, a second contact portion is formed on the upper-end portions of the second protrusion portions, the second contact portion is formed to be inclined at an acute angle corresponding to the shape of the first contact portion, and the second body portion except for the enlarged portion in the rotation member is inserted into the first body portion.

6. A thermochromic writing instrument including: a hollow cylindrical pen body which has upper and lower openings; a pen shim which is inserted into the pen body and accommodates a thermochromic ink composition I therein; a spring which elastically supports the pen shim; and a lower cap which is fastened to a lower portion of the pen body in a threaded manner, characterized by comprising:

an operation member which is inserted into the pen body so that a portion of the operation member is exposed to outside, the operation member including: a cylindrical first body portion, a connection portion extending from a side of the first body portion by a predetermined length perpendicular to the first body portion in a radial direction, and a clip portion integrally formed on a free end portion of the connection portion;

a rotation member which is rotatably inserted into the pen body, the rotation member including: a cylindrical second body portion and an enlarged portion being enlarged outwardly from a lower portion of the second body portion in the radial direction so as to have an outer diameter larger than an outer diameter of the second body portion;

a hollow upper cover which is coupled to an upper outside of the pen body;

an eraser means for rubbing the handwriting written by the thermochromic writing instrument and thermally discolors the handwriting using the rubbed heat occurring at this time; and a pressing portion which exposes the pen shim to a lower portion of the pen body and at the same time is capable of performing pressing and rotating operations; and a connection member which connects the pressing portion and the rotation member to each other.

7. The thermochromic writing instrument according to claim 6, characterized in that the eraser means is a first eraser which is provided so as to be capable of being detachably attached to the clip portion of the operation member, the first eraser is formed of a character-shaped portion integrally formed with the first eraser, and a clip portion insertion hole into which the clip portion can be inserted is formed on the character-shaped portion so as to penetrate in the vertical direction.

8. The thermochromic writing instrument according to claim 6, characterized in that the eraser means is an eraser which is provided so as to be capable of being detachably attached on an outer surface of the pen body in the radial direction, the eraser includes a character-shaped portion and a mounting ring integrally formed with the eraser, and the mounting ring is attached such that the upper portion thereof in the radial direction is integrally fixedly supported on the lower surface of the character-shaped portion.

9. The thermochromic writing instrument according to claim 6, characterized in that the eraser means is an eraser which is provided so as to be capable of being detachably attached on an outer surface of the pen body in the radial direction, the eraser includes a character-shaped portion and a mounting piece integrally formed with the eraser, the mounting piece is attached so that an upper portion thereof is integrally fixedly supported on a lower surface of the character-shaped portion, and a fitting portion is formed to be bent inward under the mounting piece, corresponding to this, a fitting groove is formed on the outer surface of the pen body in the radial direction so as to extend along the longitudinal direction of the pen body, and the eraser is mounted on the pen body in such a manner that the fitting portions are inserted into the fitting grooves, respectively.

* * * * *